United States Patent [19]

Pfeffer et al.

[11] Patent Number: 4,785,790

[45] Date of Patent: Nov. 22, 1988

[54] VARIABLE COMPRESSION HEIGHT PISTON ARRANGEMENT

[75] Inventors: Viktor Pfeffer; Friedrich Wirbeleit, both of Stuttgart, Fed. Rep. of Germany

[73] Assignee: Daimler-Benz Aktiengesellschaft, Fed. Rep. of Germany

[21] Appl. No.: 118,052

[22] Filed: Nov. 9, 1987

[30] Foreign Application Priority Data

Dec. 12, 1986 [DE] Fed. Rep. of Germany ..... 3642524

[51] Int. Cl.[4] ..... F02B 75/04

[52] U.S. Cl. ..... 123/78 B; 123/196 R

[58] Field of Search ..... 123/196 R, 78 B, 48 B

[56] References Cited

U.S. PATENT DOCUMENTS

| | | | |
|---|---|---|---|
| 3,200,798 | 8/1965 | Mansfield | 123/48 B |
| 3,403,662 | 10/1968 | Blackburne | 123/78 B |
| 4,502,421 | 3/1985 | Perry | 123/196 R |

FOREIGN PATENT DOCUMENTS

| | | | |
|---|---|---|---|
| 1751703 | 10/1978 | Fed. Rep. of Germany . | |
| 1044803 | 9/1983 | U.S.S.R. | 123/48 B |
| 1456495 | 11/1976 | United Kingdom | 123/196 R |

*Primary Examiner*—E. Rollins Cross

*Attorney, Agent, or Firm*—Barnes & Thornburg

[57] ABSTRACT

An arrangement for the control of the oil feed into a control chamber of a piston with variable compression height for internal-combustion engines comprises a control valve in the longitudinal bore of a connecting rod that is provided with a flow-through bore for the oil supply of the control chamber in the operation of the internal-combustion engine. This flow-through bore is closed as a function of the inertial forces acting in the oil feed. In order to avoid a ceasing of the oil column in the longitudinal bore, the control valve has an additional control bore that is opened only in the starting phase and via which an additional amount of oil is guided from the lubricating oil circuit of the internal-combustion engine into the control chamber, which accelerates the upward control of the piston.

8 Claims, 2 Drawing Sheets

VARIABLE COMPRESSION HEIGHT PISTON ARRANGEMENT

BACKGROUND AND SUMMARY OF THE INVENTION

The invention relates to an arrangement for controlling the oil feed into a control chamber of a piston with variable compression height, particularly for internal-combustion engines, which control chamber is arranged between an interior piston part coupled to a connecting rod and an exterior piston part that is slidably guided at the interior part, and which control chamber is connected to the lubricating oil circuit of the internal-combustion engine, via an oil feed system which includes a longitudinal oil bore through the connecting rod shaft. A control valve is disposed in the longitudinal oil bore to control oil flow therethrough.

In the case of a known arrangement of the above-mentioned type (DE-PS No. 17 51 703), the control valve is developed within the longitudinal bore of the connecting rod as a simple check valve that, as a result of its mass, when the accelerating forces act in the direction of the crankshaft, closes an inflow bore. As a result, it is avoided that, particularly in the BDC-range of the piston, the oil column that is located above the valve, because of its inertial force directed at the crankshaft, can flow off in the direction of the connecting rod bearing. However, the check valve cannot prevent that, when the internal-combustion engine is stopped, because of leakages, oil escapes from the control chamber of the piston and as a result, the compression height at the piston is reduced, which results in a deterioration of the cold start behavior of the internal-combustion engine.

It is therefore an objective of the invention to improve the known check valve in such a way that, particularly during a cold start, the piston, within a short period of time, can be adjusted to its maximum compression height.

According to the invention, this objective is achieved by providing that the control valve has slidable automatically opening additional oil supply bore feed openings during engine starting operation.

By means of the invention, it is achieved that the check valve, in addition to its previous blocking function, can be used also for the control of the oil volume from the lubricating oil circuit into the control chamber of the piston.

By means of the arrangement of an additional control bore in the valve, which is opened only in the starting phase, an additional amount of oil is controlled into the control chamber for a short time, by means of which a rapid upward control of the piston into the position of the maximum compression height is achieved. The resulting increase of the compression pressure in the combustion chamber improves the starting of the engine, particularly during a cold start.

Other objects, advantages and novel features of the present invention will become apparent from the following detailed description of the invention when considered in conjunction with the accompanying drawings.

DETAILED DESCRIPTION OF THE DRAWINGS

Figure 1:
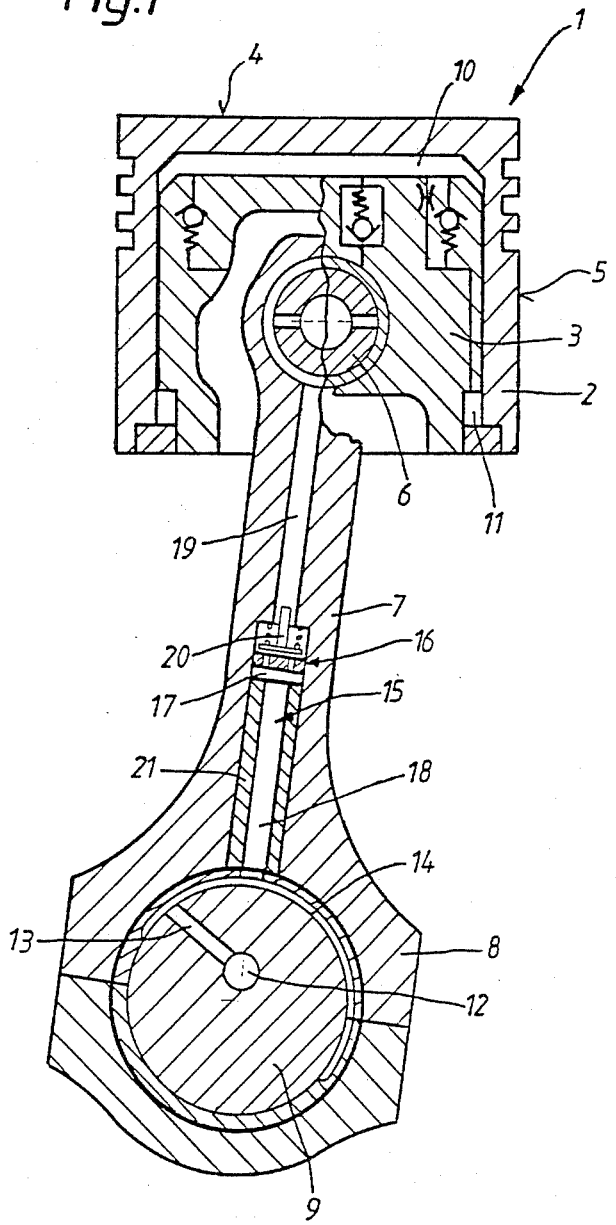
FIG. 1 is a longitudinal sectional schematic view of a piston with a variable compression height and of a connecting rod with a control valve that is arranged in a longitudinal bore, constructed in accordance with preferred embodiments of the invention.

A piston with a variable compression height that in FIG. 1 has the reference number 1 comprises an exterior piston part 2 and an interior piston part 3. The exterior piston part 2 contains the piston head 4 as well as the piston skirt 5, and is held at the interior piston part 3 so that it can be slid via the piston skirt 5. In the interior piston part 3, a piston pin 6 is inserted into two pin eyes, a connecting rod 7 being coupled to this piston pin 6. This connecting rod 7 is disposed at a lifting journal 9 of a crankshaft that is not shown in detail, via a connecting rod bearing 8.

A first control chamber 10 is enclosed between the exterior piston part 2 and the interior piston part 3, this first control chamber 10 being connected with a second control chamber 11 on the side of the connecting rod in a way that is known per se. Both control chambers are filled with engine oil from the lubricating oil circuit that, in a way that is also known, is fed from a main oil bore 12 in the crankshaft, through a transverse bore 13 in the crank pin 9, a control oil groove 14 in the connecting rod bearing 8, a longitudinal bore 15 in the connecting rod 7, as well as unmarked control oil grooves and bores in the small connecting rod eye in the piston pin 6 and in the interior part 3 of the piston, into the control chamber 10.

In the course of the longitudinal bore 15, a control valve 16 is arranged in a valve chamber 17. By means of the valve chamber, the longitudinal bore 15 is divided into a bore portion 18 on the side of the crank pin and a bore portion 19 on the side of the piston.

The valve chamber 17 is formed by a cylindrical expansion of the bore portion 18 which, after the valve body 20 is inserted into the valve chamber 17, is narrowed down again to the bore cross-section of the bore portion 19 on the side of the piston by means of a taper sleeve 21.

Figure 2:
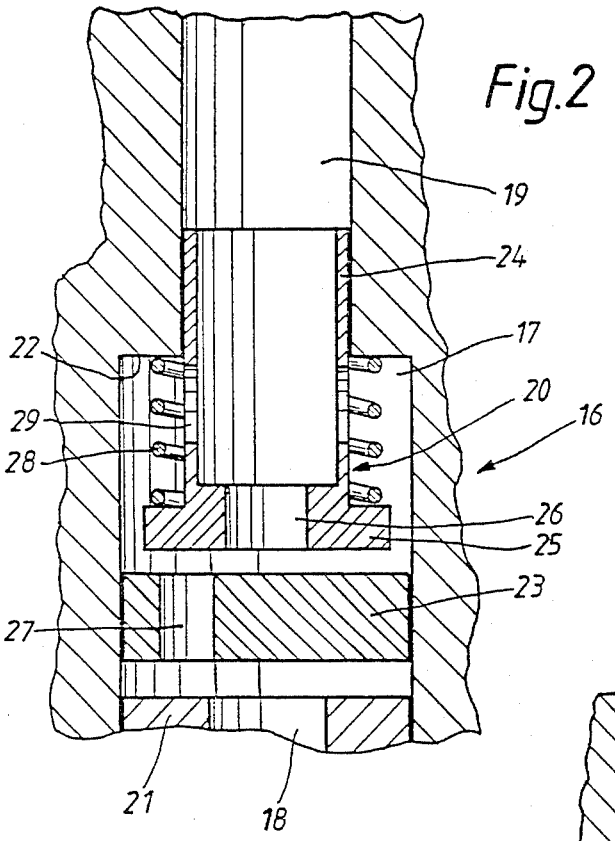
FIG. 2 is an enlarged sectional view of the control valve from FIG. 1, shown in the control position during the cold start phase.
Figure 3:
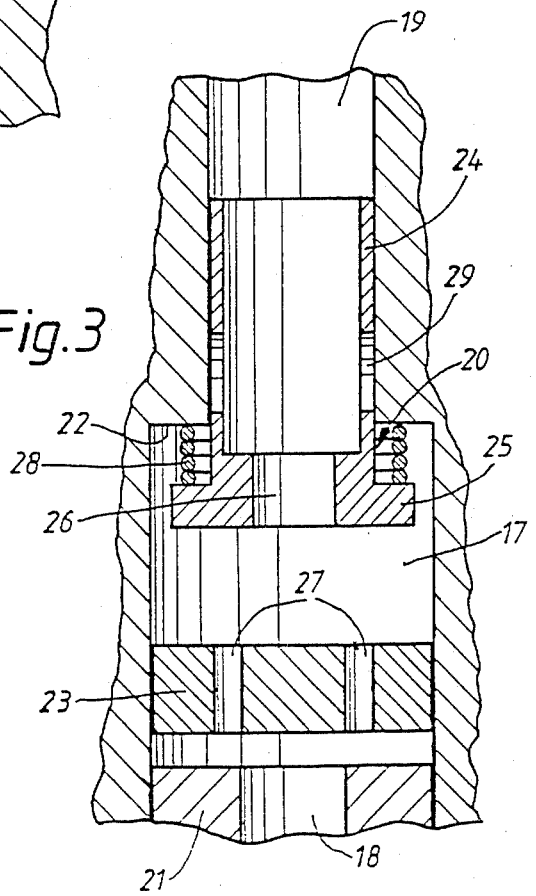
FIG. 3 is an enlarged sectional view of the control valve from FIG. 1, shown in the control position during idling and depicting a modified valve seat.

According to FIGS. 2 and 3, the valve chamber 17 extends from a shoulder 22 at the transition to the bore portion 19 on the piston side to a valve seat disk 23 (or directly to the mouth of the taper sleeve 21 in the bore portion 18 in other non-illustrated embodiments). The valve body 20 that projects into the valve chamber 17 comprises a guide shaft 24 in the shape of a hollow cylinder that has a valve plate 25 and is slidably inserted into the bore portion 19 on the piston side. The valve plate 25 contains a flow-through bore 26 that, together with a bore 27 that is arranged offset with respect to it in the valve seat disk 23, forms a controlled oil connection between the two bore portions 18 and 19. If the passage bore in the taper sleeve 21 is arranged offset with respect to the flow-through bore 25, the valve seat disk 23 will not be necessary, in other non-illustrated embodiments.

The valve body 20, as a function of the pressure of the engine oil flowing in through the bore portion 18, and of the acceleration force, is moved against the force of a spring 28 from its closed position, in which the valve plate 25 rests on the valve seat disk 23, into an upper opened position. In this case, the spring 28 supports itself at the shoulder 22 and presses against the back of the valve plate 25. When the pressure in the bore portion 18 falls, or when the inertial force of the oil column located above the valve body 20 in the bore portion 19 acts in the direction of the crankshaft, the valve body 20, supported by the spring 28, is moved into the closing position. As a result, it is prevented that, when the engine is stopped or during the operation, the oil column in the longitudinal bore 15 may cease.

The force of the spring 28 is coordinated with the lubricating oil pressure and the mass of the valve body 20 in such a way that, in the case of a lubricating oil pressure that builds up in the starting phase, the valve plate 25 is first only pushed into an intermediate position that is lifted off the valve seat disk 23, as shown in FIG. 2. According to the invention, the guide shaft 24 has an additional control bore 29 which, in the intermediate position, is controlled to be completely open. With an increasing rotational speed of the engine, the lubricating oil pressure as well as the acceleration force rises and slides the valve body 20 from the intermediate position into the upper opened position according to FIG. 3 so that, when the idling operation is reached, the oil volume transported to the control chamber 10 is determined exclusively by the cross-section of the flow-through bore 26. For the delivery of the additional oil volume in the starting phase through the open control cross-sections of the flow-through bore 26 and the control bore 29, these are coordinated with the other cross-sections in the whole inlet system between the crankshaft and the control chamber in such a way that the control cross-sections of both bores 26 and 29 together amount to about 10% to 100% of the cross-section in the inlet system. In order to achieve a fast upward controlling of the piston 1 in the starting phase, it is advantageous to develop the cross-section of the control bore 29 two to ten times larger than the cross-section of the flow-through bore 26.

Deviating from the construction according to FIG. 2, in the embodiments of FIG. 3 the bore 27 in the valve seat disk 23 comprises several bore segments that surround the flow-through opening 26 in the shape of a circular ring.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. An arrangement for controlling the oil feed into a control chamber of a piston with variable compression height, particularly for internal-combustion engines, said control chamber being arranged between an interior piston part coupled to a connecting rod and an exterior piston part that is guided at the interior piston part on the outside, and the oil feed being controlled by a control valve that is inserted into a longitudinal bore of the connecting rod, said control valve having a valve body that can be moved in a valve chamber between a bore portion of the longitudinal bore on the side of the crank pin and a bore portion of the longitudinal bore on the piston side, said valve body closing off the bore portion on the side of the crank pin when resultant forces act in the direction of the crankshaft, wherein the valve body is guided in the bore portion on the piston side and is provided with a flow-through bore that determines the oil inflow volume from the idling operation to the nominal rotational speed, as well as with an additional control bore that is opened only during the starting process for the control of an additional oil inflow volume.

2. An arrangement according to claim 1, wherein the valve body comprises a guide shaft in the shape of a hollow cylinder that is inserted into the bore portion on the piston side and has a valve plate that projects into the valve chamber and is enlarged in its diameter, the control bore being provided in the guide shaft, and the flow-through bore being provided in the valve plate.

3. An arrangement according to claim 1, wherein the bore portion on the side of the crank pin has a cylindrical widening, in which the valve chamber extends between a shoulder at the transition to the bore portion on the piston side and a taper sleeve that is pushed into said widening, the passage bore of said taper sleeve having the same cross-section as the bore portion on the piston side.

4. An arrangement according to claim 3, wherein the bore portion in the taper sleeve is arranged to be axially offset with respect to the flow-through bore.

5. An arrangement according to claim 1, wherein a restoring spring is arranged between the shoulder and a collar at the valve plate.

6. An arrangement according to claim 2, wherein the bore portion on the side of the crank pin has a cylindrical widening, in which the valve chamber extends between a shoulder at the transition to the bore portion on the piston side and a taper sleeve that is pushed into said widening, the passage bore of said taper sleeve having the same cross-section as the bore portion on the piston side.

7. An arrangement according to claim 6, wherein a restoring spring is arranged between the shoulder and a collar at the valve plate.

8. An arrangement according to claim 4, wherein a restoring spring is arranged between the shoulder and a collar at the valve plate.

* * * * *